US005590514A

United States Patent [19]

Mann et al.

[11] Patent Number: 5,590,514

[45] Date of Patent: Jan. 7, 1997

[54] FLAT-BELT DRIVE SYSTEM FOR RING-SPINNING MACHINE

[75] Inventors: Peter Mann, Süssen; Thomas Benkert, Deggingen, both of Germany

[73] Assignee: Zinser Textilmaschinen GmbH, Ebersbach/Fils, Germany

[21] Appl. No.: 587,580

[22] Filed: Jan. 17, 1996

[30] Foreign Application Priority Data

Jan. 20, 1995 [DE] Germany ..... 195 01 626.2

[51] Int. Cl.[6] ..... D01H 13/00

[52] U.S. Cl. ..... 57/104; 57/75; 57/105

[58] Field of Search ..... 57/75, 104, 105

[56] References Cited

U.S. PATENT DOCUMENTS

| | | | |
|---|---|---|---|
| 4,730,448 | 3/1988 | Wolf et al. | 57/105 |
| 4,893,460 | 1/1990 | Wolf | 57/105 |
| 4,944,144 | 7/1990 | Katoh et al. | 57/105 |
| 5,179,826 | 1/1993 | Yasuda et al. | 57/104 |

FOREIGN PATENT DOCUMENTS

| | | | |
|---|---|---|---|
| 3802200 | 8/1989 | Germany . | |
| 3916363 | 11/1990 | Germany . | |
| 432430 | 3/1948 | Italy | 57/104 |

*Primary Examiner*—William Stryjewski
*Attorney, Agent, or Firm*—Herbert Dubno; Andrew Wilford

[57] ABSTRACT

A ring-spinning machine has a longitudinally extending row of spindles rotatable about parallel spaced axes on a frame, and a drive that has an endless flat belt tangentially engaging all of the spindles. A pair of deflector rollers between two of the spindles are rotatable about respective axes parallel to the respective spindle axes and spaced longitudinally apart along the belt. A drive wheel is rotatable about an axis parallel to and spaced transversely from the roller and spindle axes and the belt passes around one of the deflector rollers, around the drive wheel, and around the other of the deflector rollers. A motor rotates the drive wheel about the wheel axis.

4 Claims, 2 Drawing Sheets

FLAT-BELT DRIVE SYSTEM FOR RING-SPINNING MACHINE

FIELD OF THE INVENTION

The present invention relates to a ring-spinning machine, More particularly this invention concerns a flat-belt drive system for such a machine.

BACKGROUND OF THE INVENTION

A standard ring-spinning machine has two parallel rows of spindles mounted on a spindle-bank support and rotatable about vertical axes. An endless flat drive belt tangentially engages whorls of the spindles to rotate them about their axes. The advantage of this system is that an individual spindle can be stopped without stopping the other spindles, either simply by braking its whorl so the belt slips on it or by pushing the belt radially away from the spindle whorl of the spindle to be stopped.

In order to avoid excess tension in the belt it is known, for example from German patent document 3,802,200 of H. Wolf, to provide several drives along the belt, in effect subdividing it into several driven sections. To do this a rather thin flat belt is used and two vertically superposed but independently rotatable rollers are used between two adjacent spindles. The belt is deflected around one of the rollers to a drive wheel and then extends back to the other roller, undergoing a vertical offset established by setting the drive wheel to rotate about an axis forming a small acute angle to the vertical and by setting the two deflector rollers at similar but oppositely tipped angles. This system is fairly effective, but requires that a fairly thin belt be used and that the whorls be fairly long. Since some of the whorls will be engaged by the belt high and some low, force transmission is not as exact as it would be with a standard center engagement with a wide belt.

Another arrangement described in German patent document 3,916,363 of T. Kato et al eliminates the deflector rollers and simply puts the drive wheel at the same level but offset from the row of spindle whorls. The resultant drive force is fairly uneven, however, as the belt will be quite tight on the incoming side and loose on the outgoing side. Furthermore it becomes difficult or impossible to stop or brake the spindles immediately flanking the drive location.

OBJECTS OF THE INVENTION

It is therefore an object of the present invention to provide an improved flat-belt drive system for a ring-spinning machine.

Another object is the provision of such an improved flat-belt drive system for a ring-spinning machine which overcomes the above-given disadvantages, that is which is fairly simple, ensures uniform driving of the spindles of the machine, and uses a fairly wide drive belt.

SUMMARY OF THE INVENTION

A ring-spinning machine has a longitudinally extending row of spindles, i.e. spindles spaced apart in a longitudinal direction of the machine, rotatable about parallel spaced axes on a frame, and a drive that has according to the invention an endless flat belt tangentially engaging all of the spindles. A pair of deflector rollers between two of the spindles are rotatable about respective axes parallel to the respective spindle axes and spaced longitudinally apart along the belt. A drive wheel is rotatable about an axis parallel to and spaced transversely from the roller and spindle axes and the belt passes around one of the deflector rollers, around the drive wheel, and around the other of the deflector rollers. A motor rotates the drive wheel about the wheel axis.

In this manner the drive belt is not deflected at the drive so that a full-width drive belt can be used. Furthermore auxiliary drives for individual spindles are unnecessary.

According to the invention the deflector rollers are of such a diameter and their axes are so positioned that the deflector rollers are generally tangent to a main plane itself tangent to the spindles and running along the belt. They are also tangent to respective planes spaced by a distance a/2 from a secondary plane substantially perpendicular to the main plane and equispaced between the axes of the two spindles. They furthermore are tangent to respective imaginary cylinders centered on the respective spindle axes and of a radius equal to W+a, where W is a radius of the respective spindle and a is a small distance equal to at least 5 mm.

According to the invention means is provided for displacing the deflector rollers in a direction transverse to the row and for securing the deflector rollers in any of a multiplicity of transversely offset positions. The frame is formed at each roller with a transversely extending groove and the displacing means includes a respective slide transversely displaceable in each of the slots and carrying the respective deflector roller and respective bolts braced between the frame and the slides and rotatable to transversely displace the respective slides in the respective grooves.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
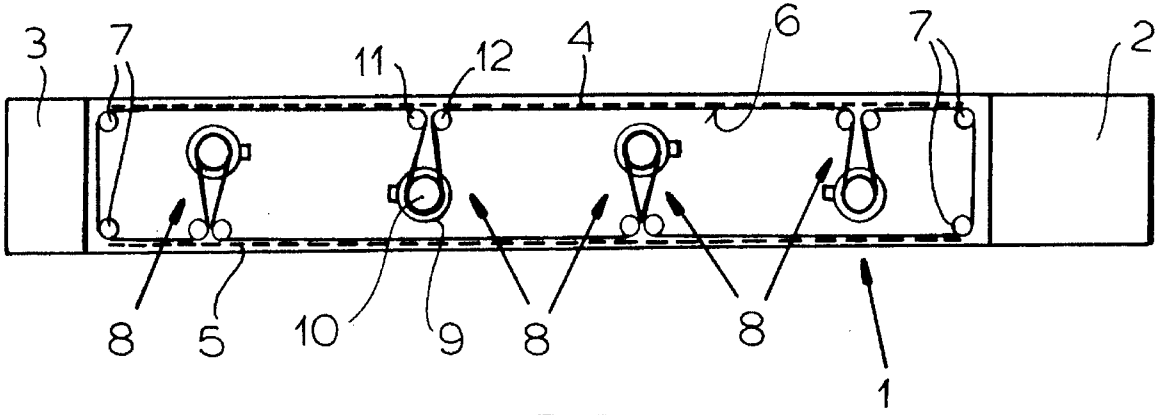
FIG. 1 is a small-scale top view of a ring-spinning machine according to the invention.
Figure 4:
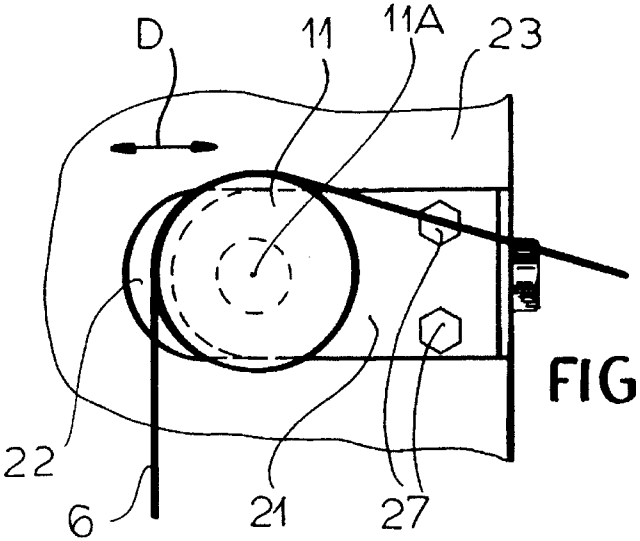
FIG. 4 is a top view of the detail of FIG. 3.
Figure 2:
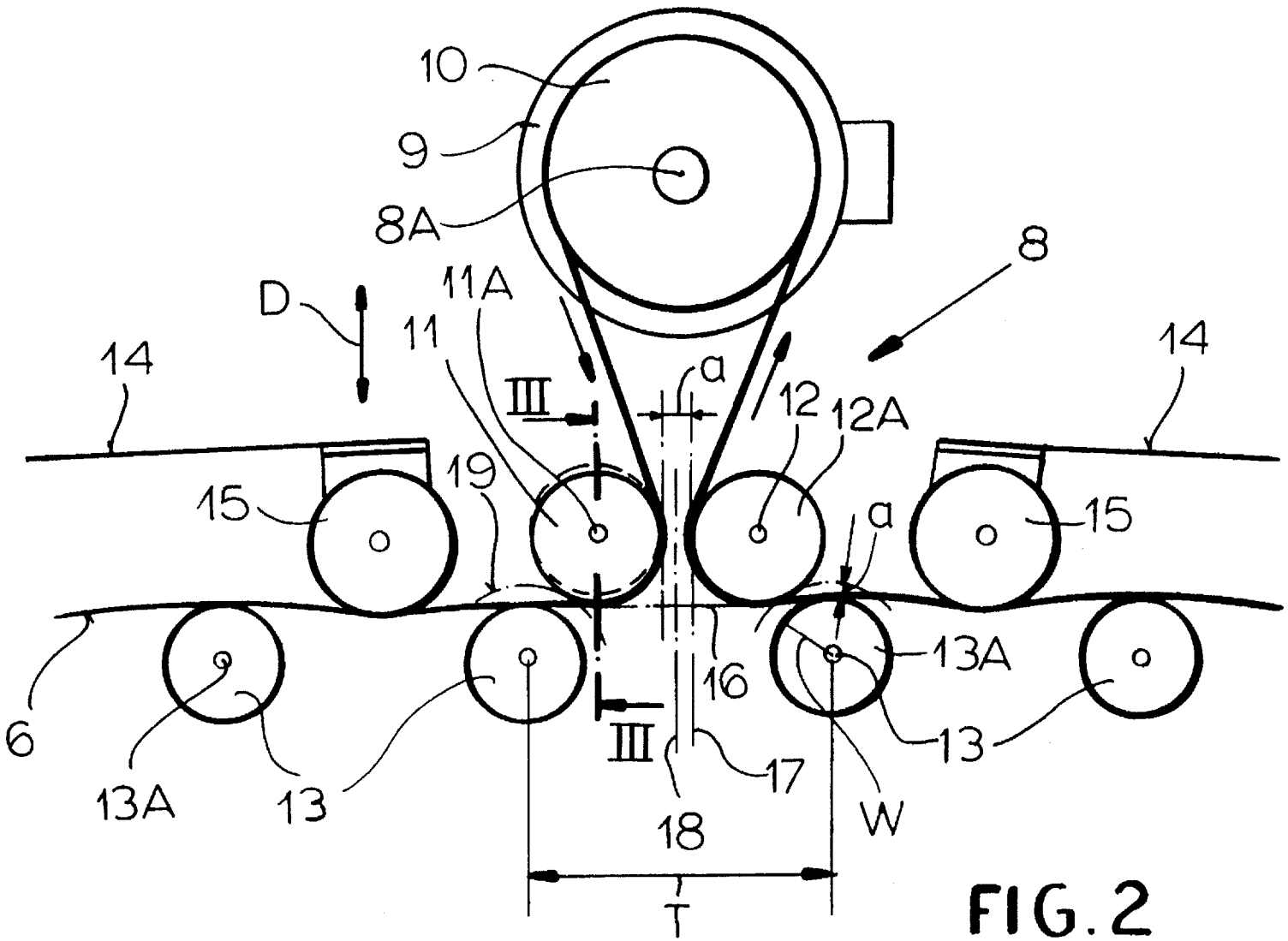
FIG. 2 is a large-scale view of a detail of FIG. 1.

As seen in FIG. 1 a ring-spinning machine 1 with a starting frame 2 and an ending frame 3 has two rows 4 and 5 of spindles 13 (FIG. 2) rotatable about respective vertical axes 13A. An endless flat belt 6 engages all the spindles 13 and passes around corner deflecting rollers 7 at the ends of the rows 4 and 5. At several points along its path, the belt 6 is engaged by a drive unit 8 comprising rollers 11 and 12 and a drive wheel 10 rotatable about a vertical axis 8A by a motor 9. The rollers 11 and 12 are positioned between two spindles 13 and are rotatable about vertical axes 11A and 12A that are parallel to the axes 8A and 13A. Leaf springs 14 carry push rollers 15 that press the belt 6 against the spindles 13.

The axes 13A of adjacent spindles 13 are spaced apart by a distance T and each spindle 13 has where it is engaged by the belt 6 a radius W which is roughly the same as the radii of the deflector rollers 11 and 12. More particularly the diameter of the deflector rollers 11 and 13 is such that they can fit between adjacent spindles 13 without the ingoing and outgoing stretches of the belt 6 passing around them touching each other. In order to insure orderly operation the rollers 11 and 12 are tangent a plane 16 tangent to the spindles 13 on the side where they are engaged by the belt 6 (There may be some movability perpendicular to this plane 15 as described below.), a plane 17 parallel to a vertical plane 18 midway between the two spindles 13 between which the rollers 11 and 12 are engaged and perpendicular to the plane 16, and an arc or cylinder 19 centered on the respective axis 13A and of a diameter equal to W plus a dimension a of at least 5 mm which is greater than twice the thickness of the belt 6 and is also the peripheral spacing between the rollers 11 and 12 at their points of closest approach. The planes 17 are spaced by a/2 from the plane 18.

Figure 3:
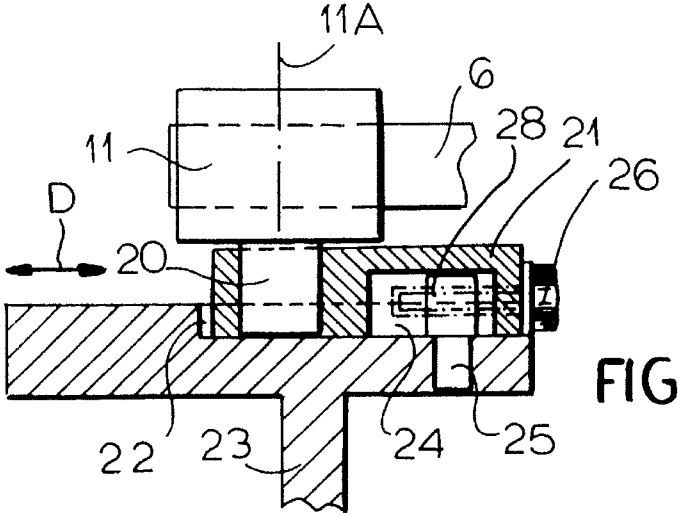
FIG. 3 is a section taken along line III—III of FIG. 2.

FIG. 3 shows how the roller 11 is carried on a shaft 20 journaled in a slide 21 that can move perpendicular to the plane 16 in a direction D in a groove 22 in the frame 22 of the machine 1. This slide 21 is formed with a downwardly open elongated cutout 24 engaging over a pin 25 seated in the frame 23 and formed with a threaded bore 28 in which engages a bolt 26 extending in the direction D and having a head bearing against the slide 21. Two bolts 27 engaging through slots in the slide 21 are threaded into the frame 23. The roller 12 is identically mounted.

Thus when the bolts 27 are loosened the slide 21 can move in the direction D to adjust the position of the roller 11 or 12 perpendicular to the plane 16. This is useful since the tension on the part of the belt 6 going into the wheel 10 from the roller 12 is substantially higher than in the part going out from it to the roller 11, so that the roller 12 can be set slightly back from the plane 16 to ensure uniform frictional engagement of the belt 6 with the spindles 13.

We claim:

1. In combination with a ring-spinning machine having a longitudinally extending row of spindles spaced apart in a longitudinal direction of the machine and rotatable about parallel spaced axes on a frame, a drive comprising:

an endless flat belt tangentially engaging all of the spindles;

a pair of deflector rollers between two successive spindles of the row and rotatable about respective axes parallel to the respective spindle axes and spaced apart in said longitudinal direction along the belt;

a drive wheel rotatable about a drive wheel axis parallel to and spaced transversely from the rollers, said drive wheel axis being further spaced from respective spindle axes transversely to said longitudinal direction, the belt at each drive wheel passing initially around a respective one of the deflector rollers, then around the drive wheel, and then around the other of the deflector rollers; and motor means for rotating the drive wheel about the wheel axis, said drive wheel, said deflector rollers and said spindles all being engaged by said belt in a single belt plane.

2. The ring-spinning machine defined in claim 1 wherein the deflector rollers are of such a diameter and their axes are so positioned that the deflector rollers are generally tangent to a main plane itself tangent to the spindles and running along the belt, the deflector rollers are each also tangent to respective further planes spaced by a distance a/2 from a secondary plane substantially perpendicular to the main plane and equispaced between the axes of the two spindles, and the deflector rollers are also tangent to respective imaginary cylinders centered on the respective spindle axes and of a radius equal to W+a, where W is a radius of the respective spindle and the value a of said distance and said radius is a small distance equal to at least 5 mm and is less than a spacing between successive spindles of the row.

3. The ring-spinning machine defined in claim 1, further comprising means for displacing the deflector rollers in a direction transverse to the row and for securing the deflector rollers in any of a multiplicity of transversely offset positions.

4. The ring-spinning machine defined in claim 1 wherein the frame is formed at each roller with a transversely extending groove and the means for displacing the deflector rollers includes a respective slide transversely displaceable in each of the grooves and carrying the respective deflector roller, and respective bolts braced between the frame and the slides and rotatable to transversely displace the respective slides in the respective grooves.

* * * * *